US007758482B2

(12) United States Patent
Stevenson

(10) Patent No.: US 7,758,482 B2
(45) Date of Patent: Jul. 20, 2010

(54) APPARATUS AND METHOD FOR ASSEMBLING ENCLOSURE ASSEMBLIES

(75) Inventor: David Stevenson, Lymington (GB)

(73) Assignee: Le Carton Limited, St. Martins, Guernsey (GB)

( * ) Notice: Subject to any disclaimer, the term of this patent is extended or adjusted under 35 U.S.C. 154(b) by 698 days.

(21) Appl. No.: 10/583,627

(22) PCT Filed: Dec. 15, 2004

(86) PCT No.: PCT/GB2004/005239

§ 371 (c)(1),
(2), (4) Date: Feb. 5, 2007

(87) PCT Pub. No.: WO2005/061333

PCT Pub. Date: Jul. 7, 2005

(65) Prior Publication Data

US 2007/0193615 A1 Aug. 23, 2007

(30) Foreign Application Priority Data

Dec. 22, 2003 (GB) ..... 0329487.3

(51) Int. Cl.
*B31B 1/52* (2006.01)

(52) U.S. Cl. ..... 493/102; 493/56; 493/73; 493/75; 493/76; 493/80

(58) Field of Classification Search ..... 493/102, 493/52, 56, 73, 75–76, 79–81, 84
See application file for complete search history.

(56) References Cited

U.S. PATENT DOCUMENTS 3,634,995 A * 1/1972 Curtis ..... 53/485
4,380,447 A * 4/1983 VanderLugt, Jr. ..... 493/102
4,461,137 A * 7/1984 Wood ..... 53/456
4,504,350 A * 3/1985 Joo ..... 156/380.8
5,184,996 A * 2/1993 Rode et al. ..... 493/84
5,351,465 A * 10/1994 Fortnam et al. ..... 53/492
5,393,291 A * 2/1995 Wingerter ..... 493/116
5,558,614 A * 9/1996 Anderson et al. ..... 493/312

FOREIGN PATENT DOCUMENTS

| | | | |
|---|---|---|---|
| BE | 840677 | A | 8/1976 |
| DE | 29505346 | U1 | 5/1995 |
| EP | 0 697 339 | A1 | 2/1996 |
| WO | 02/098751 | A1 | 12/2002 |

* cited by examiner

*Primary Examiner*—Christopher Harmon
(74) *Attorney, Agent, or Firm*—Christensen O'Connor Johnson Kindness PLLC

(57) ABSTRACT

An apparatus (21) for assembling a collapsible enclosure assembly (1) onto a container (11), the enclosure assembly (1) being of the type comprising a plurality of collapsible walls (2, 3, 4) and which is adapted to be supported, when erected, on the container (11) so that in situ the enclosure assembly (1) encloses a region above the container (11), the apparatus (21) comprising means to move a collapsed enclosure assembly (1) from a storage position (25) to an assembly position (36), means to move the walls (2, 3, 4) of the collapsed enclosure assembly (1) when in the assembly position (36) relatively apart to expand the enclosure assembly (1) so as to be of generally tubular form, and means to mount the expanded enclosure assembly (1) on a corresponding container (11). A method for assembling a collapsible enclosure assembly (1) onto a container (11) is also provided.

32 Claims, 6 Drawing Sheets

APPARATUS AND METHOD FOR ASSEMBLING ENCLOSURE ASSEMBLIES

The present invention relates to a method of assembling enclosure assemblies and in particular to assembling enclosure assemblies which comprise a plurality of interconnected, collapsible walls and which are adapted to be supported on a container so that, in situ, the enclosure assembly encloses a region above the container.

Such enclosure assemblies are known and are described in Patent Specification No. PCT/GB02/02569 of Trans-Aqua Limited. It is desirable to be able to quickly and efficiently expand such enclosure assemblies from a collapsed position and mount the expanded enclosure assemblies on respective containers.

According to a first aspect of the invention there is provided an apparatus for assembling a collapsible enclosure assembly onto a container, the enclosure assembly being of the type comprising a plurality of collapsible walls and which is adapted to be supported, when erected, on the container so that in situ the enclosure assembly encloses a region above the container, the apparatus comprising means to move a collapsed enclosure assembly from a storage position to an assembly position, means to move the walls of the collapsed enclosure assembly when in the assembly position relatively apart to expand the enclosure assembly so as to be of generally tubular form, and means to mount the expanded enclosure assembly on a corresponding container.

Preferably the apparatus is for assembling collapsible enclosure assemblies of the type comprising a first two opposed walls and a second two opposed walls, the enclosure assembly, when expanded, being of quadrilateral cross section.

Preferably the apparatus comprises a storage means for storing at least one collapsed enclosure assembly. Preferably the storage means comprises a chute, the enclosure assembly being located between parallel side walls of the chute in a substantially upright condition with the enclosure assembly being adjacent to an end wall of the chute.

Preferably the chute is inclined with the end wall being lowermost.

Preferably the base of the chute is provided with conveyor means to convey a collapsed enclosure assembly towards the end wall of the chute.

Preferably the end wall is spaced from the end margins of the side walls of the chute by a distance greater than the thickness of the enclosure assembly when in the collapsed condition.

Preferably the conveyor means is of walking beam type comprising two, parallel beams that sequentially move upwardly, forwardly and then downwardly to sequentially lift the enclosure assembly, move the enclosure assembly towards the end wall of the chute and to lower the enclosure assembly.

Preferably the chute stores multiple collapsed enclosure assemblies in a substantially horizontal row.

Preferably the means to move the collapsed enclosure assembly from the storage position to the assembly position comprises a first planar element that is movable between the storage position and the assembly position and against which the collapsed enclosure assembly can rest, and retaining means to grab a collapsed enclosure assembly from the storage position and to retain the enclosure assembly on the first planar element.

Preferably the retaining means grabs and retains a first wall of the enclosure assembly.

Preferably the first planar element is mounted on a carriage that is movable along a guide rail on the apparatus. Preferably the guide rail is located substantially perpendicularly to the longitudinal axis of the chute.

Preferably the means to move the walls of the enclosure assembly relatively apart comprises means to pull an opposed wall away from the first wall of the enclosure assembly.

Alternatively, the means to move the walls apart comprises means to push an opposed wall away from the first wall of the enclosure assembly.

Preferably the means to pull the opposed wall comprises a second planar element against which the opposed wall of the collapsed enclosure assembly can rest, and retaining means associated with the planar element to grab the opposed wall of the collapsed enclosure assembly to retain the enclosure assembly on the planar element.

Preferably the second planar element of the means to move the walls of the enclosure assembly relatively apart is movable between a position adjacent the first planar element in which the second planar element grabs and retains the opposed wall of the enclosure assembly and, when so retained, a position distal from the first planar element, the movement from the position adjacent the first planar element to the position distal the first planar element pulling the opposed wall of the enclosure assembly away from the first wall of the enclosure assembly to expand the enclosure assembly.

Preferably each planar element comprises a plate.

Preferably the retaining means comprises a finger that is movable between a first orientation and a second orientation, the finger being received in part of the respective wall of the enclosure assembly when in a first orientation, movement of the finger to the second orientation retaining the respective wall of the enclosure assembly on the respective planar element.

Preferably the finger is rotatable between the first and second orientation.

Preferably the part of the enclosure assembly comprises an aperture, the finger being adapted to extend through the aperture when in the first orientation but not being removable through the aperture when in the second orientation.

Preferably the rotatable finger is mounted on a shaft that is operative to extend the finger through the aperture and rotate the finger to the second orientation.

Preferably the finger extends substantially perpendicularly from the longitudinal axis of the shaft.

Preferably the retaining means on each planar element comprises two rotatable fingers.

Alternatively the retaining means on each planar element comprises a suction cup adapted to suck onto a wall of the enclosure assembly using a vacuum.

Preferably each suction cup is connected to a vacuum source.

Preferably the apparatus further comprises container storage means.

Preferably the container storage means is located distal from the assembly position.

Preferably the container storage means stores multiple containers in a substantially vertical stack.

Preferably conveyor means are provided to convey a container from the container storage means to the assembly position such that the container is positioned beneath an enclosure assembly when the enclosure assembly is in the expanded condition at the assembly position.

Preferably lifting means are provided to lift the container into engagement with the expanded enclosure assembly to enable the enclosure assembly to be mounted on the container.

Preferably the lifting means comprises a pivotable arm on which the container rests, the arm being pivotable between a lowered position and a raised position. Preferably the arm is pivotable using a hydraulic ram.

According to a second aspect of the invention there is provided a method of assembling a collapsible enclosure assembly of the type comprising a plurality of collapsible walls and which is adapted to be supported, when erected, on a container so that, in situ, the enclosure assembly encloses a region above the container, the method comprising moving a collapsed enclosure assembly from a storage position to an assembly position, moving the walls of the enclosure assembly relatively apart to expand the collapsed enclosure assembly when in the assembly position so that the enclosure assembly is of generally tubular form, and mounting the erected enclosure assembly on a corresponding container.

Preferably the method comprises pulling at least one wall of the collapsed enclosure assembly away from the other walls.

Preferably the enclosure assembly comprises a first two opposed walls and a second two opposed walls, the method comprising moving the first two opposed walls relatively apart and then moving the second two opposed walls apart.

Preferably the method comprises initially retaining a first wall of the enclosure assembly and moving the retained enclosure assembly to the assembly position.

Preferably the method then comprises retaining an opposed wall of the enclosure assembly and then pulling the opposed wall away from the first wall to expand the enclosure assembly.

Preferably the method further comprises conveying a container from a container storage means to the assembly position and positioning the container beneath the expanded enclosure assembly.

Preferably the method comprises lifting the so positioned container into engagement with the expanded enclosure assembly.

Other aspects of the present invention may include any combination of the features or limitations referred to herein.

The present invention may be carried into practice in various ways, but embodiments will now be described by way of example only with reference to the accompanying drawings in which.

Figure 1:
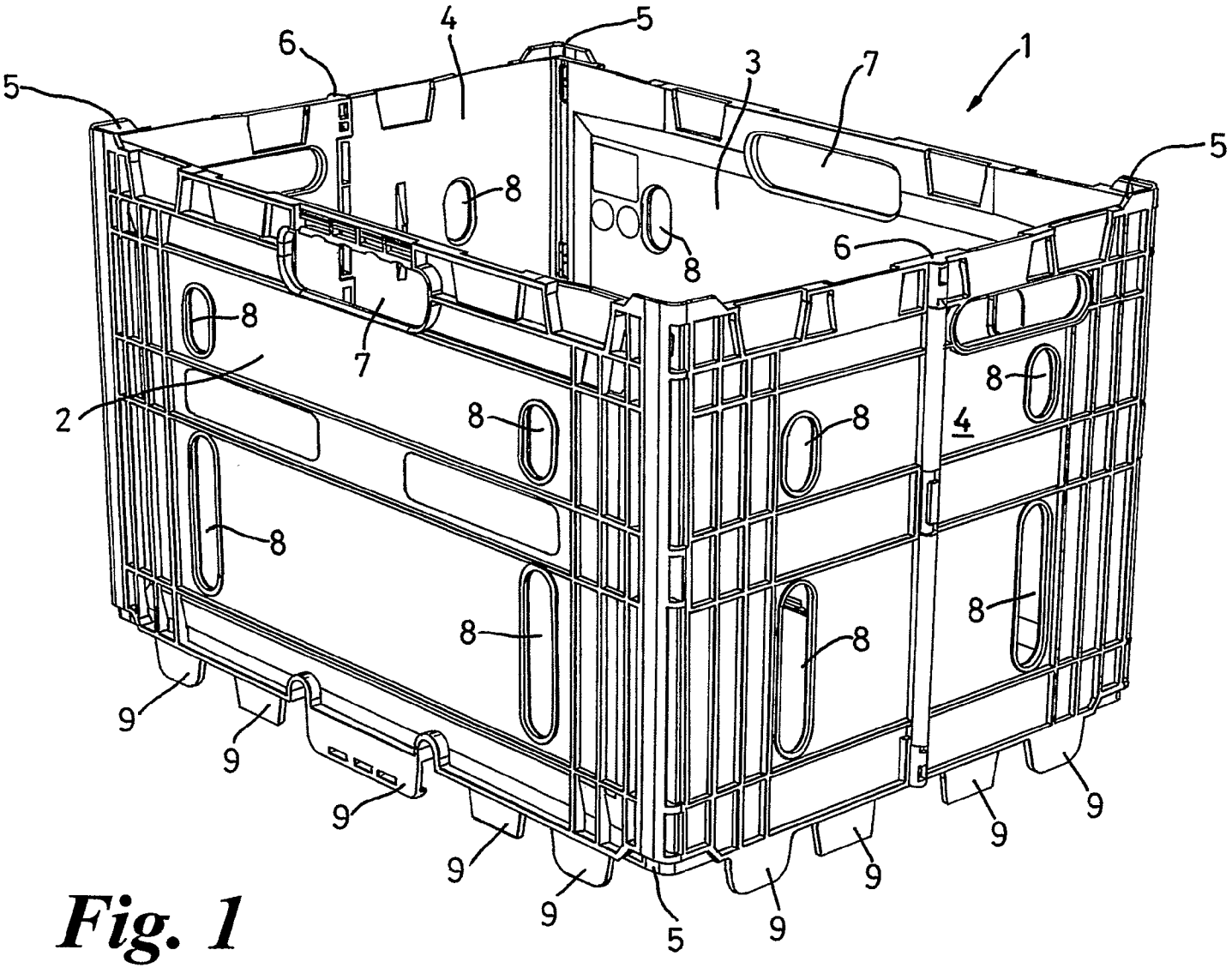
FIG. 1 is a perspective view of an expanded enclosure assembly as used with the apparatus of the present invention.
Figure 2:
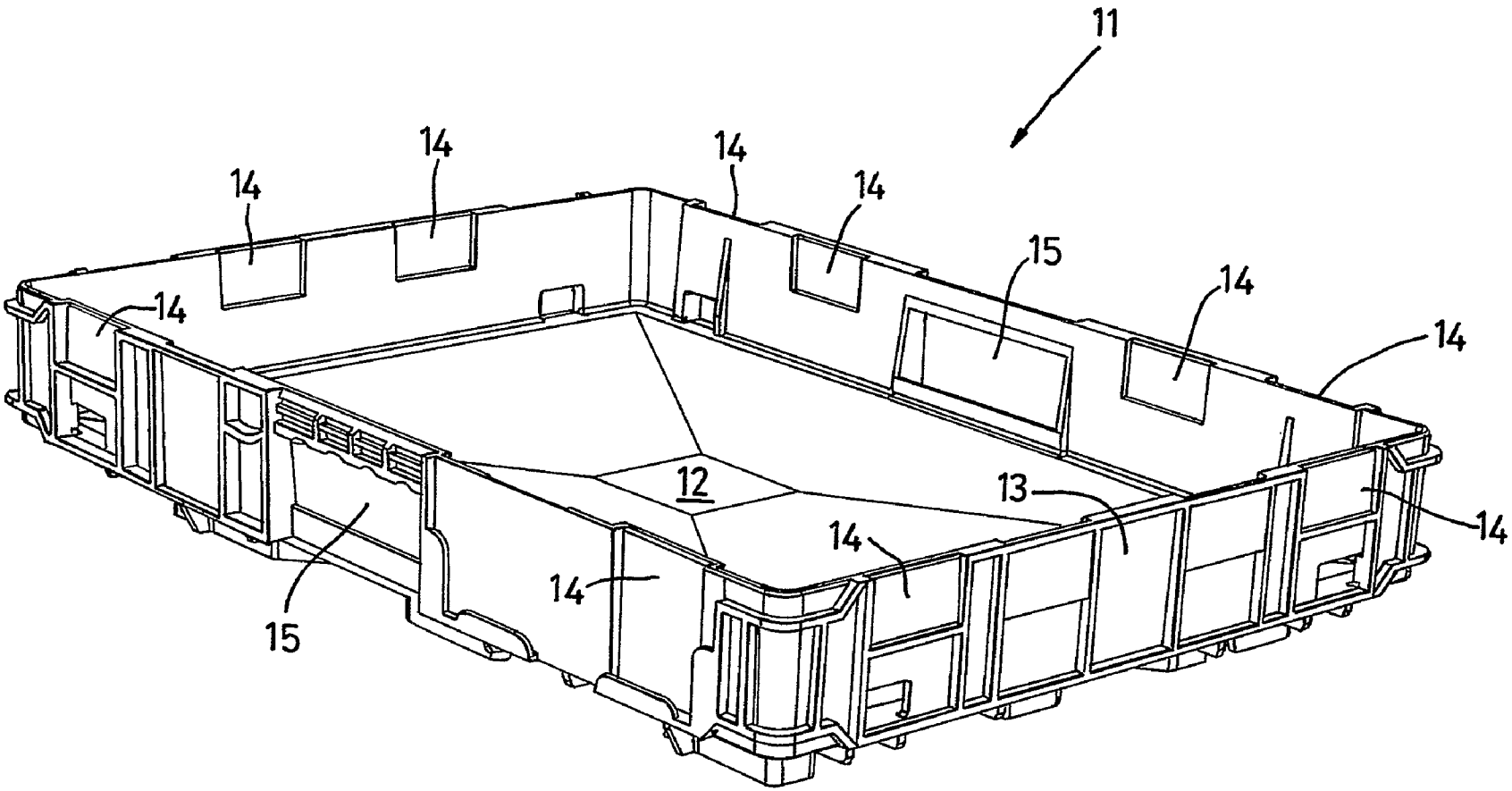
FIG. 2 is a perspective view of a container as used with the apparatus of the present invention.

The apparatus shown in FIGS. 3 to 6 is for assembling an enclosure assembly and container as shown in FIGS. 1 and 2.

Referring initially to FIGS. 1 and 2, an enclosure assembly 1 comprises a front and rear wall 2, 3 hingedly connected 5 to side walls 4. The side walls 4 themselves are hinged 6 midway between the front and rear walls 2, 3. It will be appreciated that the hinges 5, 6 enable the enclosure assembly 1 to be collapsed from the expanded condition shown in FIG. 1 wherein the enclosure assembly 1 is of tubular form, to a collapsed position wherein the enclosure assembly is substantially planar. When collapsed the side walls 4 hinge inwardly towards the centre of the expanded enclosure assembly 1 so that the front and rear walls 2, 3 move towards one another. When fully collapsed the side walls 4 are parallel with, and sandwiched between, the front and rear walls 2, 3.

The front and rear walls 2, 3 are each provided, adjacent their respective upper margins, with a handle aperture 7 and with two horizontal rows of spaced apart venting apertures 8 that are of generally elongate shape with the longitudinal axis of each aperture 8 being substantially vertical. Any suitable combination of handle apertures 7 and venting apertures 8 may be used. The side walls 4 also have two rows of venting apertures 8.

The lower margin of the walls 2, 3 and side walls 4 are provided with downwardly projecting tabs 9.

Referring to FIG. 2, a container 11 comprises a rectangular base 12 and a peripheral rim 13 upstanding from the base 12. The rim 13 is provided with slots or recesses 14 to receive the tabs 9 formed on the lower margin of the enclosure assembly. The container 11 is also formed with two handle apertures 15 on opposed sides of the rim 13. When received on the container 11 the expanded enclosure assembly 1 is releasably secured to the container 11 by the tabs 4 being received in the recesses 14 so that the container and enclosure assembly together form a box. The cooperation between each tab 9 and the respective recess 14 may be a snap fit cooperation or an interference fit or merely a sliding fit.

Figure 3:
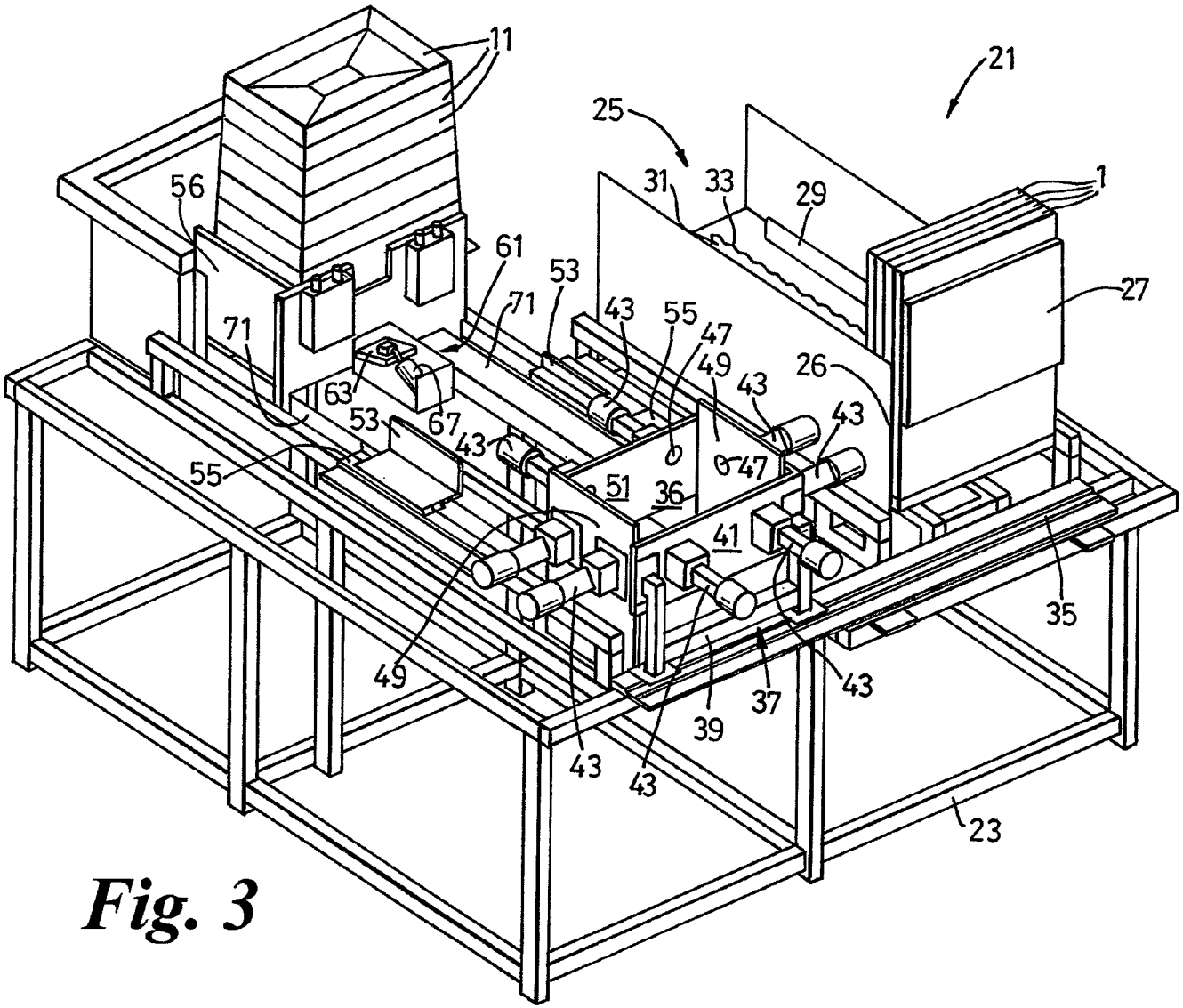
FIG. 3 is a perspective view of an apparatus in accordance with the present invention.
Figure 4:
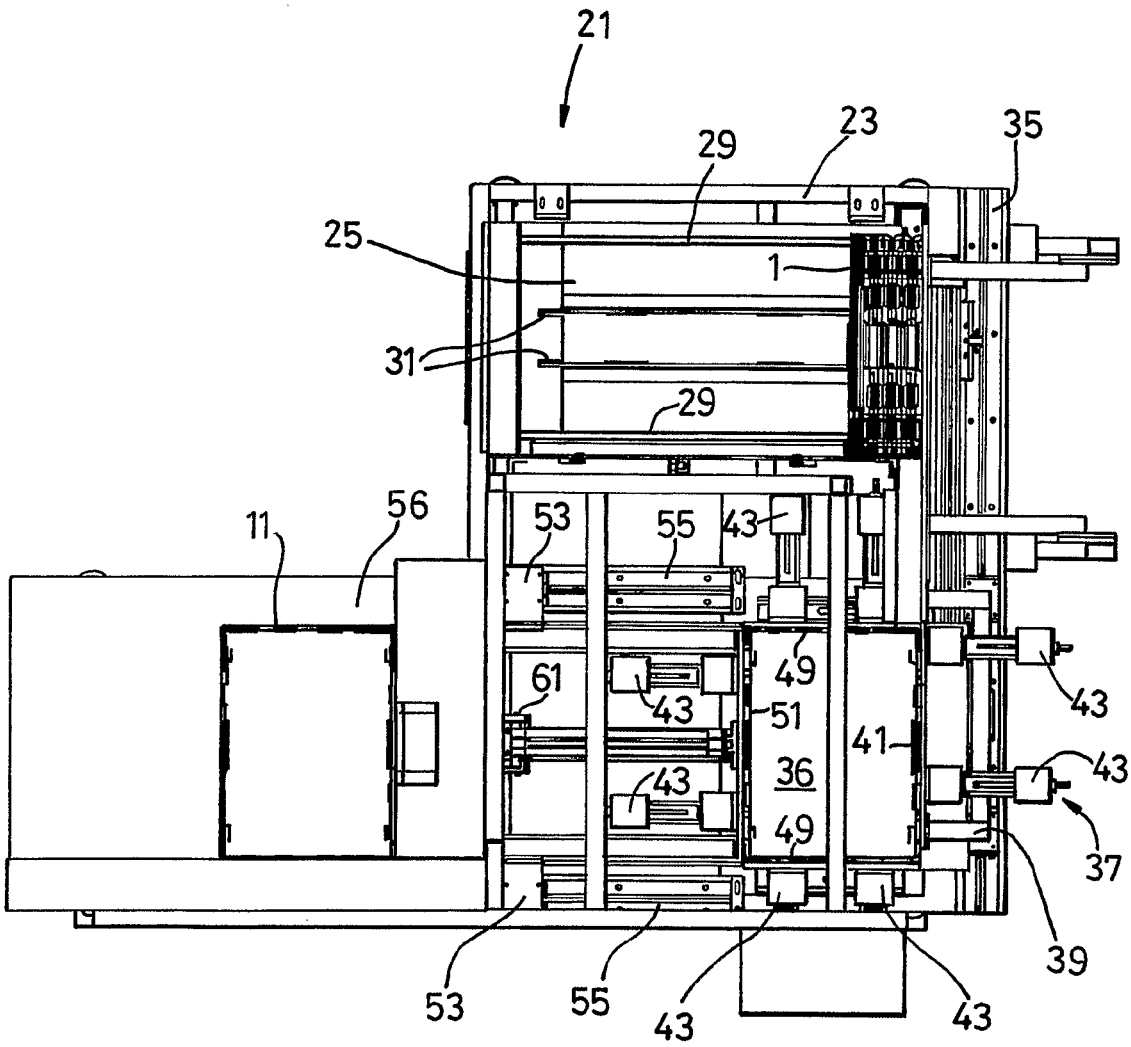
FIG. 4 is a plan view of the apparatus of FIG. 3.

Referring now to FIGS. 3 and 4, an apparatus 21 comprises a base framework 23 of interconnected struts.

Mounted on the frame work 23 is an enclosure assembly storage means comprising a chute 25 that is inclined so that one end 26 of the chute 25 is lower than the other end of the chute 25. The lower end 26 of the chute 25 is closed by a chute end wall 27. A plurality of collapsed enclosure assemblies 1 are stored in the chute 25 with the planes of the collapsed enclosure assemblies 1 being substantially parallel with the chute end wall 27. The chute 25 thus comprises a storage position of the apparatus 21. It will be appreciated that the chute end wall 27 is spaced from the end of the chute 23 by a distance slightly greater than the thickness of a single collapsed enclosure assembly 1. This is to enable a collapsed enclosure assembly 1 to be slid from the lower end 26 of the chute 25 through the space between the end wall 27 and the chute 25 in a direction parallel to the end wall 27. The lower margin of the end wall 27 is also spaced above the base of the chute 25.

The base of the chute 25 is provided with conveyor means comprising guide rails 29 along which the collapsed enclosure assemblies 1 can slide so as to move towards the lower end 26 of the chute 25. This movement can be achieved using gravity alone if the chute 25 is inclined appropriately. However, the conveyor means of the chute 25 further comprises two parallel walker beams 31 that are mounted in the base of the chute 25 and have serrated upper faces 33 to positively engage the collapsed enclosure assemblies 1.

The walker beams 31 are mounted in such a way that, in use, one beam 31 can move sequentially upwardly, forwardly and then downwardly to lift an enclosure assembly 1, move the enclosure assembly 1 towards the lower end 26 of the chute 25, and then lower the enclosure assembly 1 back onto the guide rails 29. The second walker beam 31 then effects a similar movement to move the enclosure assembly 1 further towards the lower end 26 of the chute 25.

The lower end 26 of the chute 25 is adjacent a rail 35 which extends along one margin of the framework 23 in a direction perpendicular to the longitudinal axis of the chute 25.

A carriage 37 is slidably mounted on the rail 35 so as to be able to slide along the rail 35 from a position adjacent the lower end 26 of the chute 25 to an assembly position 36 remote from the chute 25. The carriage 37 and rail 35 thus comprise means to move the enclosure assembly from the storage position to the assembly position 36.

The carriage 37 comprises a framework 39 on which is mounted a planar front plate 41. Retaining means comprising two spaced apart actuators 43 are mounted on the front plate 41. Each actuator 43 comprises a shaft 45 that extends through the front plate 41 and terminates in a finger 47, the axis of the finger 47 being perpendicular to the axis of the shaft 45 such that the finger 47 extends radially outwardly from the shaft 45. The other end of the shaft 45 is connected to motor means that is operative to push or pull the shaft 45 through the front plate 41 and to rotate the shaft 45 so as to rotate the finger 47 about the axis of the shaft 45.

When the carriage 37 and front plate 41 are in the assembly position 36, the front plate 41 comprises one wall of a rectangular space that is slightly larger than an expanded enclosure assembly 1. The rectangular space is defined between the front plate 41, two side plates 49 that are perpendicular to the front plate 41, and a back plate 51 that is parallel to the front plate 41.

The side plates 49 are fixedly mounted on the framework 23 and are each provided with two actuators 43 as described above.

The back plate 51 is mounted on two carriages 53 that are slidably mounted on respective parallel rails 55 that extend perpendicularly away from rail 35 and which are mounted on the framework 23. The back plate 51 is movable between a first position as shown in FIGS. 3 and 4 wherein the back plate 51 is spaced from the front plate 41, to a second position in which the back plate 51 is adjacent front plate 41 so as to be spaced only a small distance therefrom, the distance being slightly greater than the thickness of a collapsed enclosure assembly 1. The back plate 51 is also provided with two spaced apart actuators 43 as described above.

It will be appreciated that the fingers of each actuator 43 could be replaced by any other suitable means to retain part of the enclosure assembly 1. Such other means could include a suction cup or cups that can be releasably attached to part of the enclosure assembly 1 using a vacuum within the cup. Such suction cups may be appropriate if the enclosure assembly 1 is not provided with venting apertures.

In addition, the fingers 47 can alternatively or additionally be moved from a position aligned with the axis of the shaft 45, to a position substantially axially perpendicular to the axis of the respective shaft 45. Any other suitable formation may alternatively be provided instead of the fingers 47, such as, for example, a hook.

A container storage means is provided comprising a storage box 56 in which multiple containers 11 are stored in vertically stacked formation. The box 56 is mounted on the framework 43 and is spaced behind the back plate 51.

Two lifting means 61 are provided at the base of the box 56 in a guide channel 59. Each lifting means 61 comprises an arm 63 pivotally mounted on one end of a respective housing 65. Part of the housing has been removed for clarity. The arm 63 is connected to a hydraulic or pneumatic ram 67 also mounted in the housing 65. The hydraulic ram 67 is operative to pivot the arm 63 from a substantially horizontal position to a substantially vertical position. The lowermost container 11 rests on the arm 63 of each of the two lifting means 61 with the arms 63 in an inclined position as can be seen from FIG. 3. The arms 63 are at the front and rear of the container 11 and thus serve to locate the container 11 on the lifting means 61.

The lifting means 61 are both mounted on the framework 23 for movement between the container box 56 and the assembly position 36 between the side plates 49. Conveyor means are provided to convey the lifting means 61, and the lowermost container 11 rested thereon, from the container stack in the storage box 55, along the framework 23 and into the assembly position 36 between the side plates 49. The container 11 is pushed along the guide channel 59 which is defined between two parallel guide beams 71 mounted in the framework 23. Any suitable conveyor means can be provided including a hydraulic or pneumatic ram or a conveyor belt of any suitable type.

In use, the various components of the apparatus 21 are initially in the positions shown in FIGS. 3 and 4, namely the front and back plates 41, 51 are adjacent the side plates 49 at the assembly position 36.

The carriage 37 on which the front plate 41 is mounted then slides along rail 35 to move the front plate 41 to the lower end 36 of the chute 35. The front plate 41 fits in the space between the lower margin of the end wall 26 of chute 25 and the chute base, with a wall 2 of the lowermost collapsed enclosure assembly 1 resting against the end wall 26 and the front plate 41. The actuators 43 are then actuated to extend their respective shafts 45 and fingers 47 through the respective apertures 8 formed in the wall 2 of the enclosure assembly 1. The apertures may be venting apertures or may be handles or may be apertures formed solely for the purpose of assembling the enclosure assembly.

When the fingers 47 of the actuators 43 have been received through the respective apertures 8 in the enclosure assembly 1, the shaft 45 of each actuator 43 rotates to rotate the respective finger 47 to a second orientation wherein the finger 47 cannot pass through the respective aperture 8. It will be recalled that each aperture 8 is an elongate aperture whose longitudinal axis extends from top to bottom of each wall 2, 3, 4 of the enclosure assembly 1. Thus to pass through the aperture 8 the longitudinal axis of the finger 47 is initially similarly orientated. When in the second orientation the longitudinal axis of the finger 47 is offset from being aligned with longitudinal axis of the respective aperture 8 and thus may be, for example, perpendicular to the longitudinal axis of the aperture.

When the fingers 47 are so orientated, the enclosure assembly 1 is secured to and is retained by the front plate 41 which then slides along the rail 35 to the assembly position 36 wherein the front plate 41 is adjacent side plate 49, the collapsed enclosure assembly 1 being located between the side plates 49. This position is shown in FIG. 5A wherein it will be noted that back plate 51 is spaced from the collapsed enclosure assembly 1.

Figure 5B:
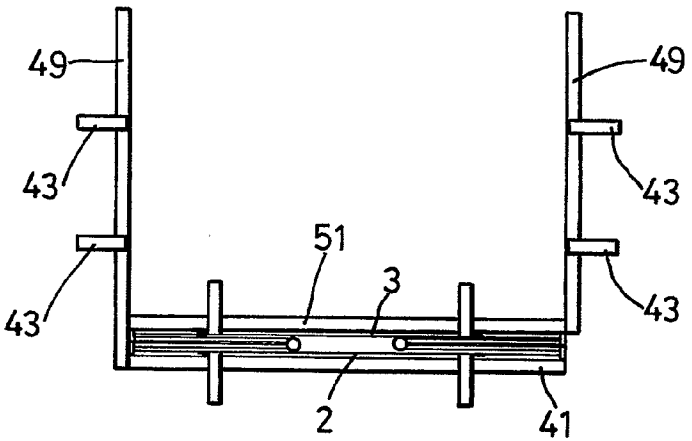
FIGS. 5A to 5D are plan views of part of the apparatus of FIG. 3 in four different conditions.

The back plate 51 then moves along the parallel rails 55 towards the collapsed enclosure assembly 1 to the position shown in FIG. 5B in which the back plate 51 is adjacent the collapsed enclosure assembly 1.

The actuators 43 on the back plate 51 are then actuated so that the shafts 45 of each actuator 43 extend through respective apertures 8 formed in the back wall 3 of the collapsed enclosure assembly 1 that is adjacent the back plate 51. When the fingers 47 of each actuator 43 have passed through the apertures 8, the fingers 47 rotate through 90° so that the fingers 47 can then not be removed through the apertures 8. The back wall 3 of the collapsed enclosure assembly 1 is thus retained on the back plate 51.

Figure 5D:
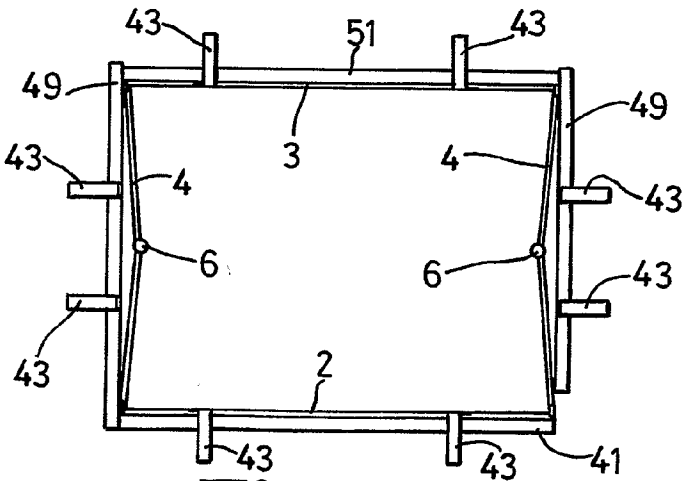
Figure 5A:
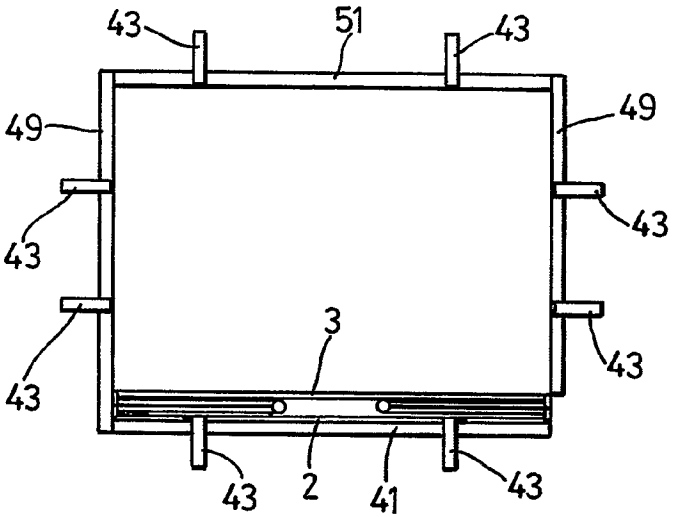
Figure 5C:
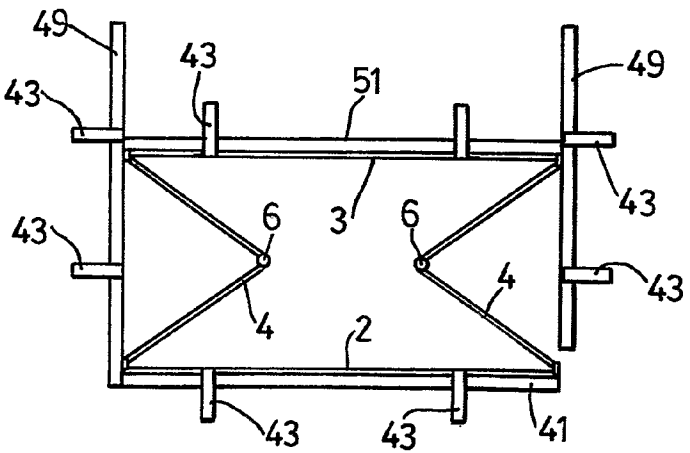

The back plate 51 then slides backwardly along the parallel rails 55 away from the front plate 41. As the back plate 51 moves, it brings the rear wall 3 of the enclosure assembly 1 with it so as to partially expand the enclosure assembly 1 as can be seen from FIG. 5C. The back plate 51 continues sliding away from the front plate 41 until the back wall 3 that is retained by the back plate 51 is spaced from the front wall 2 retained by the front plate by a distance substantially equal to the dimension of the enclosure assembly 1 between the front and back walls 2, 3 when the enclosure assembly 1 is fully expanded. This is shown in FIG. 5D.

It will be appreciated that as the back plate 51 moves away from the front plate 41 the back wall 3 retained by the back plate 51 pulls the side walls 4 of the enclosure assembly 1 towards the side plates 49. This is due to the hinged connections 5, 6 between each adjacent wall 2, 3, 4 of the enclosure assembly 1.

The actuators 43 of each side plate 49 are then actuated so that the shaft 45 and finger 47 of each actuator 43 extend through the apertures 8 formed in the side walls 4 of the enclosure assembly 1. The shafts 45 are then rotated through approximately 90° so that the side walls 4 are retained on the side plates 49 as can be seen from FIG. 6A.

The shaft 45 of each actuator 43 is then moved back into the actuator 43 so as to pull the retained side walls 4 of the enclosure assembly 1 towards the respective side plate 49 so that each wall 2, 3, 4 of the enclosure assembly 1 is substantially perpendicular to the adjacent wall 2, 3, 4 of the enclosure assembly 1. The enclosure assembly 1 is thus in a fully expanded tubular condition of rectangular form when viewed in plan as can be seen from FIG. 6B.

Figure 6A:
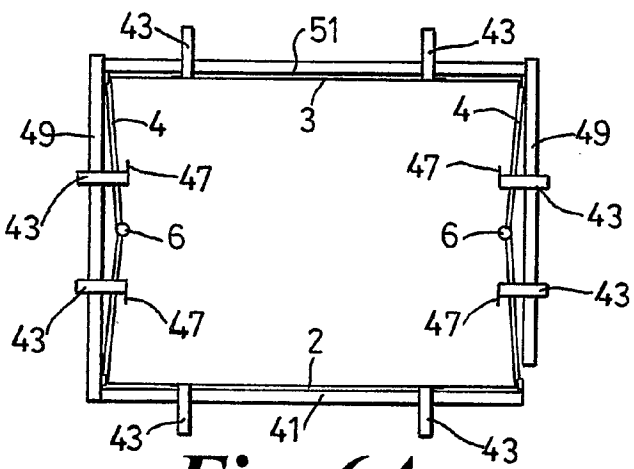
FIGS. 6A to 6D are plan views of the part of the apparatus shown in FIG. 5 but in a further four different conditions.
Figure 6B:
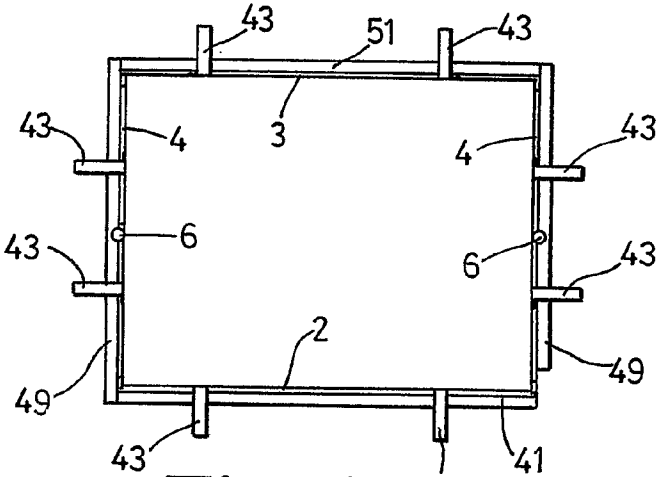
Figure 6C:
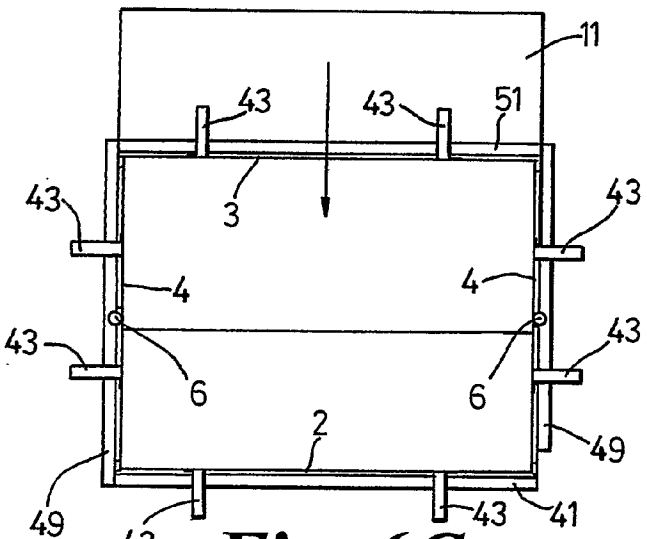
Figure 6D:
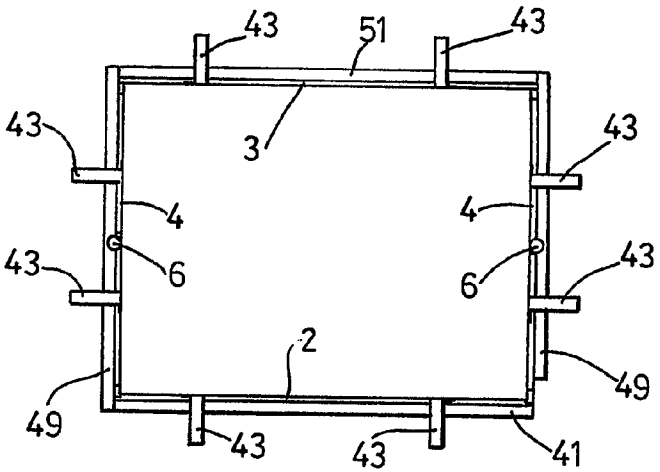

When the enclosure assembly 1 is fully expanded, the lowermost container 11 is conveyed from the container storage box 55 by moving the lifting means 61 away from the storage box 55. The container 11 is conveyed underneath the expanded enclosure assembly 1, as can be seen in FIG. 6C, to a position in which the container 11 is aligned with the expanded enclosure assembly 1 as can be seen from FIG. 6D.

The container 11 is then raised upwardly towards the enclosure assembly 1 by actuating the hydraulic ram 67 of each lifting means 61 to pivot each arm 63 about the respective housing 65. The margins of the container 11 that are resting on the arms 63 slide up the arms 63 and thus the container 11 is raised upwardly. When so raised, the recesses 14 of the container 11 mate with the tabs 9 formed on the lower margin of the enclosure assembly 1. This may be achieved using any suitable cooperating formations on the enclosure assembly 1 and the container 11 including snap fit formations.

The container 11 and expanded enclosure assembly 1 together define a box having a base and four upstanding walls that can be used to store and transport any suitable goods. The assembled box is then pushed from the apparatus 1 by back plate 51, as the front plate 41 is collecting the next collapsed enclosure assembly 1 from the chute 25.

It will be appreciated that the moving carriages and plates and actuators can be operated using any suitable mechanism including electric motors, hydraulics, pneumatics or electro magnetic means such as solenoids or the like. These components have not been illustrated for clarity.

It will also be appreciated that the apparatus 21 could be used to assemble other enclosure assemblies and containers having differing features to those specifically described herein.

It is also envisaged that the walls of the enclosure assembly 1 could be expanded outwardly using means located or adapted to be located on the inside of the collapsed enclosure assembly so as to push the collapsed walls into the expanded position. Such means could comprise an expanding plunger that is inserted, from above or below, between the walls of the collapsed enclosure assembly. The plunger could comprise an inflatable bag that inflates so as to push the walls outwardly or could comprise a plurality of levers that rotate about the axis of the plunger to push the walls outwardly.

So it is envisaged that the walls of the collapse enclosure assembly could be pushed outwardly from the inside rather than pulling the walls outwardly from the outside of the enclosure assembly.

The invention claimed is:

1. An apparatus (21) for assembling a collapsible enclosure assembly (1) onto a container (11), the enclosure assembly (1) being of the type comprising a plurality of collapsible walls (2, 3, 4) and which is adapted to be supported, when erected, on the container (11) so that, in situ, the enclosure assembly (1) encloses a region above the container (11), the apparatus (21) comprising:

a carriage configured to move a collapsed enclosure assembly (1) from a storage position to an assembly position (36), wherein the carriage comprises a first planar element (41) that is movable between the storage position and the assembly position (36) and against which the collapsed enclosure assembly (1) can rest, and a retainer to grab a collapsed enclosure assembly (1) from the storage position and to retain the enclosure assembly (1) on the first planar element (41);

an actuator to move the walls (2, 3, 4) of the collapsed enclosure assembly (1) when in the assembly position (36) relatively apart to expand the enclosure assembly (1) so as to be of generally tubular form, the actuator including a finger (47) positionable externally of the enclosure assembly and positionable internally of the enclosure assembly, wherein when internally located, the finger (47) engages with an internal surface of one of the walls of the enclosure assembly and when driven, the finger (47) expands the walls relatively apart, wherein the actuator to move the walls (2, 3, 4) of the enclosure assembly (1) relatively apart is arranged to pull an opposed wall away from a first wall of the enclosure assembly (1) and includes a second planar element (51) against which the opposed wall of the collapsed enclosure assembly (1) can rest, and wherein the finger is movable between a first orientation where the finger (47) is insertable through an aperture of the respective wall (2, 3) of the enclosure assembly (1) to a second orientation whereby the finger (47) retains the respective wall (2, 3) of the enclosure assembly (1) on the second planar element (51) but is not removable through the aperture; and a mounter to mount the expanded enclosure assembly (1) on a corresponding container (11).

2. The apparatus (21) of claim 1 wherein the apparatus (21) is adapted to assemble collapsible enclosure assemblies (1) of the type comprising a first two opposed walls (2, 3) and a second two opposed walls (4), the enclosure assembly (1), when expanded, being of quadrilateral cross section.

3. The apparatus (21) of claim 1 or claim 2 further comprising a storage assembly for storing at least one collapsed enclosure assembly (1).

4. The apparatus (21) of claim 3 wherein the storage assembly comprises a chute (25), the enclosure assembly (1) being located between parallel side walls of the chute (25) in a substantially upright condition with the enclosure assembly (1) being adjacent to an end wall (27) of the chute (25).

5. The apparatus (21) of claim 4 wherein the chute (25) is inclined with the end wall (27) being lowermost.

6. The apparatus (21) of claim 4 wherein a base of the chute (25) is provided with a conveyor (29, 31) to convey a collapsed enclosure assembly (1) towards the end wall (27) of the chute (25).

7. The apparatus (21) of claim 4 wherein the end wall (27) is spaced from the end margins of the side walls of the chute (25) by a distance greater than the thickness of the enclosure assembly (1) when in the collapsed condition.

8. The apparatus (21) of claim 6 wherein the conveyor (29, 31) is of walking beam type comprising two parallel beams (31) that sequentially move upwardly, forwardly and then downwardly to sequentially lift the enclosure assembly (1), move the enclosure assembly (1) towards the end wall (27) of the chute (25) and to lower the enclosure assembly (1).

9. The apparatus (21) of claim 4 wherein the chute (25) stores multiple collapsed enclosure assemblies (1) in a substantially horizontal row.

10. The apparatus (21) of claim 1 wherein the retainer is configured to grab and retain the first wall of the enclosure assembly (1).

11. The apparatus (21) of claim 1 wherein the first planar element (41) of the carriage (37) is movable along a guide rail (35) on the apparatus (21).

12. The apparatus (21) of claim 11 wherein the guide rail (35) is located substantially perpendicularly to the longitudinal axis of the chute (25).

13. The apparatus (21) of claim 1 wherein the second planar element (51) is movable between a position adjacent the first planar element (41) in which the finger grabs and retains the opposed wall of the enclosure assembly (1) against the second planar element and when so retained, is movable to a position distal from the first planar element (41), the movement from the position adjacent the first planar element (41) to the position distal the first planar element (41) pulling the opposed wall of the enclosure assembly (1) away from the first wall of the enclosure assembly (1) to expand the enclosure assembly (1).

14. The apparatus (21) of claim 13 wherein each planar element (41, 51) comprises a plate.

15. The apparatus (21) of claim 1 wherein the finger is rotatable between the first and second orientation.

16. The apparatus (21) of claim 15 wherein the rotatable finger (47) is mounted on a shaft (45) that is operative to extend the finger (47) through the aperture and rotate the finger (47) to the second orientation.

17. The apparatus (21) of claim 16 wherein the finger (47) extends substantially perpendicularly from the longitudinal axis of the shaft (45).

18. The apparatus (21) of claim 1 wherein two fingers (47) are provided for the second planar element.

19. The apparatus (21) of claim 1 wherein the retainer comprises a suction cup adapted to suck onto a wall of the enclosure assembly (1) using a vacuum.

20. The apparatus (21) of claim 19 wherein the suction cup is connected to a vacuum source.

21. The apparatus (21) of claim 1 wherein the apparatus (21) further comprises a container storage assembly (56).

22. The apparatus (21) of claim 21 wherein the container storage assembly (56) is located distal from the assembly position (36).

23. The apparatus (21) of claim 21 wherein the container storage assembly (56) stores multiple containers (11) in a substantially vertical stack.

24. The apparatus (21) of claim 21 wherein a conveyor is provided to convey a container (11) from the container storage assembly (56) to the assembly position (36) such that the container (11) is positioned beneath an enclosure assembly (1) when the enclosure assembly (1) is in the expanded condition at the assembly position (36).

25. The apparatus (21) of claim 1 wherein the mounter comprises a lift (61) to lift the container (11) into engagement with the expanded enclosure assembly (1) to enable the enclosure assembly (1) to be mounted on the container (11).

26. The apparatus (21) of claim 25 wherein the lift (61) comprises a pivotable arm (63) on which the container (11) rests, the arm (63) being pivotable between a lowered position and a raised position.

27. The apparatus (21) of claim 26 wherein the arm (63) is pivotable using a hydraulic ram (67).

28. A method of assembling a collapsible enclosure assembly (1) of the type comprising a plurality of collapsible walls (2, 3 4) and which is adapted to be supported, when erected, on a container (11) so that, in situ, the enclosure assembly (1) encloses a region above the container (11), the method comprising:

moving a collapsed enclosure assembly (1) from a storage position to an assembly position (36) with a carriage that comprises a first planar element (41) that is movable between the storage position and the assembly position (36) and against which the collapsed enclosure assembly (1) can rest, and a retainer to grab a collapsed enclosure assembly (1) from the storage position and to retain the enclosure assembly (1) on the first planar element (41);

moving the walls (2, 3, 4) of the enclosure assembly (1) relatively apart to expand the collapsed enclosure assembly (1) when in the assembly position (36) so that the enclosure assembly (1) is of generally tubular form with an actuator that includes a finger (47) positionable externally of the enclosure assembly and positionable internally of the enclosure assembly and a second planar element (51), wherein the walls are moved by inserting the finger (47) through an aperture of the respective wall (2, 3) of the enclosure assembly (1) in a first orientation such that the finger (47) engages with an internal surface of the enclosure assembly, retains the respective wall (2, 3) of the enclosure assembly on a second planar element (51) of the actuator and is not removable through the aperture;

driving the finger (47) to expand the walls relatively apart by pulling an opposed wall away from a first wall of the enclosure assembly (1); and mounting the expanded enclosure assembly (1) on a corresponding container (11).

29. The method of claim 28 wherein the enclosure assembly (1) comprises a first two opposed walls (2, 3) and a second two opposed walls (4), the method comprising moving the first two opposed walls (2, 3) relatively apart and then moving the second two opposed walls (4) apart.

30. The method of claim 28 wherein the method comprises initially retaining the first wall of the enclosure assembly (1) and moving the retained enclosure assembly (1) to the assembly position (36).

31. The method of claim 30 further comprising conveying a container (11) from a container storage assembly (56) to the assembly position (36) and positioning the container (11) beneath the expanded enclosure assembly (1).

32. The method of claim 31 wherein the method further comprises lifting the container (11) into engagement with the expanded enclosure assembly (1).

* * * * *